United States Patent [19]

Smirnykh

[11] 4,396,204

[45] Aug. 2, 1983

[54] ROLLER SKATES

[76] Inventor: Veniamin G. Smirnykh, ulitsa Kartashova, 40-a, kv. 24, Tomsk, U.S.S.R.

[21] Appl. No.: 298,169

[22] Filed: Aug. 31, 1981

[51] Int. Cl.[3] ..... A63C 17/12; A63C 17/06

[52] U.S. Cl. ..... 280/11.115; 280/11.23

[58] Field of Search ..... 280/11.115, 11.1 BT, 280/11.19, 11.2, 11.21, 11.23, 233; 180/180, 181

[56] References Cited

U.S. PATENT DOCUMENTS

| | | | |
|---|---|---|---|
| 606,854 | 7/1898 | Bergstrom | 280/233 |
| 3,285,618 | 11/1966 | Welch | 280/11.115 |
| 3,392,986 | 7/1968 | Ryan | 280/11.115 |
| 3,684,305 | 8/1972 | McDonald | 280/11.19 |

FOREIGN PATENT DOCUMENTS

| | | | |
|---|---|---|---|
| 2726961 | 1/1979 | Fed. Rep. of Germany | 280/11.115 |
| 28428 | 11/1932 | U.S.S.R. | 280/11.115 |

*Primary Examiner*—David M. Mitchell
*Assistant Examiner*—Timothy Roesch
*Attorney, Agent, or Firm*—Holman & Stern

[57] ABSTRACT

Roller skates each comprised of a base with rollers secured therein and a foot support pivotally secured thereto to pivot around the axle of the front roller, a foot propulsion drive having a spring-loaded flexible cable connected by one end thereof via an overrunning clutch to one of the rollers and by another end thereof to the foot support to rotate the roller, and a hand propulsion drive including an overrunning clutch, a spring-loaded flexible cable connected by one end thereof through the overrunning clutch to one of the rollers and a support lever secured to the base to pivot around an axis which is parallel with the axes of rotation of the rollers and having a slidable member nested therein to reciprocate inside the support lever, the slidable member being connected with another end of the flexible cable of the hand propulsion drive.

4 Claims, 7 Drawing Figures

ROLLER SKATES

The present invention relates to technical auxiliaries for sporting games and recreation, and more particularly to roller skates.

FIELD OF APPLICATION

The invention can find application as a means of transportation for both adults and children in the urban and suburban recreational areas and other locations provided with asphalt or similar hard pavement.

BACKGROUND OF THE INVENTION

A sedentary life style of the modern man caused by accelerated advancements in science and technology affects negatively to an ever increasing extent his individual physical development and health. It is for this reason that various age groups in many countries have become attracted by portable transport means propelled by the force of the muscle.

Known in the art are roller skates (cf., e.g., U.S. Pat. No. 3,684,305, Cl. 280–11.19, published Aug. 17, 1970), each of the skates comprising a base plate having rollers attached thereto. Mounted on the base serving also as a foot support is a supporting lever, the lower end of which is secured to the base to pivot around an axis which is parallel with the axes of rotation of the rollers. Propulsion is effected by virtue of a torque obtained by sudden shifts in the center of gravity of the skater and inclinations of the lever hand-held by the upper end thereof.

However, the speed of travel is rather low, which calls for the employment of additional drive means.

Also known are roller skates as exemplified by U.S. Pat. No. 3,392,986, Cl. 280–11.11, published Apr. 11, 1966. Each of the skates comprises a base with rollers arranged thereon and a driving means to rotate the rollers in response to a downward movement of the foot.

The base of each of the skates serves as a foot support and is provided with a pair of carrying members extending downwardly from each end of the base, each pair of the carrying members having laterally aligned vertical slots therein, the slots accommodating wheeled axles for rotatable and lineal movement therealong. Further, the base mounts two downwardly extending rack members disposed between each pair of the carrying members and having toothed edge portion facing the adjacent axle for meshing engagement with gear portions of the respective axles. The downward movement of the base causes the wheels of the skate which are rigidly affixed to the axles to come into engagement with a supporting surface and due to the meshing engagement to rotate to thereby propel the skate.

When the base reaches its downmost position, the wheeled axles are out of engagement with the toothed rack members, since the latter are provided with recess portions for free rotation of the geared portion of the axle therein. The wheels or rollers can thereby freewheel together with their respective axles in a direction corresponding to the direction of travel.

The drive of the skate is intended for use predominantly with walking dolls or toy figures and is hardly sufficient for transmitting considerable torques to attain required transmission ratios; as a result, the skates fail to provide satisfactory propulsion rates for a human being.

Further known are roller skates having drives for propelling a human being (cf. USSR Inventor's Certificate No. 28428, filed Dec. 14, 1931, published Nov. 30, 1932), each of the skates comprising a base provided with rollers, a foot support secured to pivot around an axis which is parallel to the axis of rotation of the rollers, and a drive mechanism made up of an overrunning clutch and a spring-loaded flexible link or cable connected by one end thereof via the overrunning clutch with one of the rollers and by another end with the foot support to rotate the roller in response to a downward movement of the foot.

The base of the skate is fashioned as an elongated frame, the upper portion of which is covered by a stationary plate, two pairs of rollers being journaled in bearings to the frame and rigidly connected in pairs by two common axles. The rear end of the base comprises a support having a drive which includes a wind-up drum and an overrunning clutch generally in the form of a ratchet-and-pawl mechanism. The wind-up drum is connected via the overrunning clutch with the axles of the rear and front rollers by means of a flexible transmission. The foot support is fashioned as a plate connected pivotally with the stationary plate and provided with means for fixing or clamping the heel portion of the foot. The rear end of the foot support is connected to the wind-up drum by a flexible link spring-loaded on the side of the driving unit.

The speed attainable with the skates of the above construction is inherently limited by the capabilities of the foot drive thereof. In addition, such roller skates fail to enable the skater to apply his muscle force to increase the rate of propulsion, which is especially the case when the skater travels in various power-consuming modes, such as sudden acceleration or taking an inclined surface. The last factor also reduces the maximum speed of steady-state motion attainable by the skater, because the transmission ratio of the drive means is deliberately lowered to provide for a margin of power capacities of the skater. Among other disadvantages of the roller skates of the above construction is the use of two pairs of rollers or wheels in each skate, the construction being heavy and inconvenient when moving on a laterally inclined supporting surface. Such a construction is further disadvantageous in that the feet of the skater must be rigidly affixed to the skates, which prevents everyday footwear of various shapes and sizes from being used in conjunction therewith.

SUMMARY OF THE INVENTION

It is an object of the present invention to increase the speed of travel on roller skates.

Another object is to provide conditions for a more efficient use of the muscular force of a human being to obtain propulsion by means of roller skates.

Another object is to improve the lateral stability of the roller skates.

One more object is to ease the use of the roller skates.

The objects are attained by that in roller skates each of which comprises a base having rollers or wheels arranged therein and a foot support secured to the base to pivot around an axis which is parallel to the axis of rotation of the rollers, and a drive means including a spring-loaded flexible link or cable connected by one end thereof via an overrunning clutch with one of the rollers and by another end with the foot support to impart rotation to the corresponding roller in response to a downward movement of the foot, according to the invention, each of the roller skates is provided with an additional or auxiliary drive means comprised of an overrunning clutch and a spring-loaded flexible link or cable connected by one end thereof via the overrunning clutch with one of the rollers, the drive being secured to the base to pivot around an axis which is essentially parallel with the axes of rotation of the rollers, a support lever having a slidable member nested for reciprocations therein, another end of the flexible cable of the auxiliary drive means being connected with the slidable member to impart rotation to the corresponding roller by the force of the hand of the skater.

Preferably, the support lever is adapted to telescope and is made up of three links, the middle link being in fact the aforementioned slidable member, a hand-grip or handle being arranged on the upper end of the medium link.

Preferably, a means is provided for fixing or clamping the upper end of the support lever to the clothes of of the skater.

The use in the herein proposed roller skate construction of the auxiliary manual drive affords to impart an added torque to the rollers to thereby increase the rate of propulsion. Therewith, the efforts applied by the feet to the foot supports of each of the skates are greatly enhanced, since the drives thereof are acted upon simultaneously by the hands and feet of the skater.

The support lever incorporated into the construction of the roller skate according to the invention serves to maintain the skate in a vertical position, i.e., provides lateral stability to the skate. This obviates the need to fix the feet rigidly to the foot supports and makes it possible to use any casual footwear regardless of the type and size thereof, which makes the use of the skates more convenient.

The telescoping arrangement of the support lever with the links thereof being capable to move or slide freely along its longitudinal axis and the employment of the upper portion of the medium link as a hand-grip facilitates the reliable functioning of the lever, since its flexural rigidity is sufficiently high despite the iterate variations in length in the course of the forward travel of the skater.

The provision of the clamping means for fixing the upper end of the support lever to the clothes of the skater, for example to the waist or armpit portion, affords easy and fast clamping the upper end of the lever, thereby relieving the hands to relax or be occupied by the hand-drive grip or by a weight.

The roller skates of the herein proposed construction enable to imitate the natural motions of walking and thus provide a more uniform distribution of physical energy exerted by the muscles of the skater. This greatly enhances the physical training and therapeutic effect associated with roller skating and helps fight the sedentary life of the modern man to improve his health and be in a more close contact with nature.

BRIEF DESCRIPTION OF THE DRAWINGS

The invention will now be described in greater detail with reference to a specific embodiment thereof taken in conjunction with the accompanying drawings, in which.

DETAILED DESCRIPTION OF THE INVENTION

Figure 1:
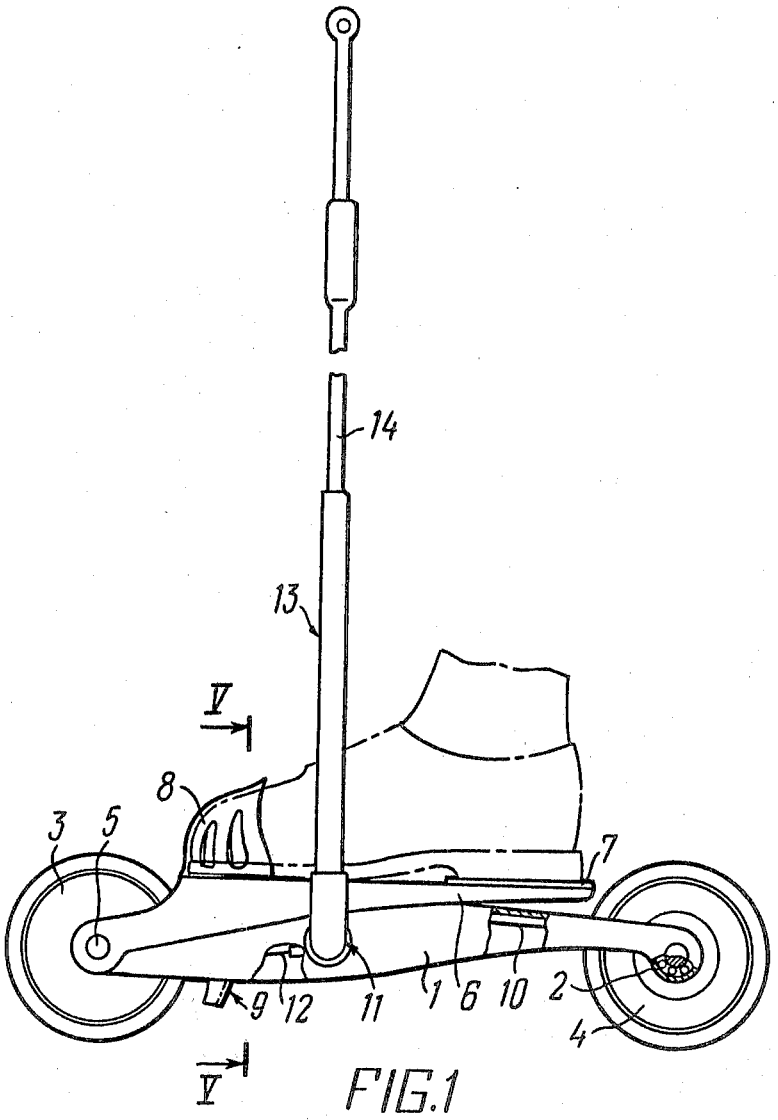
FIG. 1 is a general side view of a roller skate according to the invention with a foot of the skater outlined in a dash-dot line.

With reference to FIG. 1, a roller skate constructed according to the present invention includes a carrier element or base 1 journalling by means of anti-friction bearings 2 front and rear rollers 3 and 4, respectively. Pivotally secured to the base 1 by means of an axle 5 parallel to the axis of rotation of the rollers 3 and 4 is a foot support 6, the foot being outlined symbolically in FIG. 1 by a dash-dot line. In the proposed embodiment the foot support 6 is pivotable relative to the axis of the front roller 3. The upper surface of the foot support 6 is covered by a knurled or riffled rubber plate 7 and provided with a receptacle 8 for receiving and loosely enclosing the toe portion of the foot. Each roller comprises a drive mechanism 9 incorporating a spring-loaded flexible link or cable 10, one end of which cooperates with one of the rollers 3 or 4; in the present embodiment of the roller skate according to the invention the cable 10 is connected to the rear roller 4, the opposite end of the cable being linked with the foot support 6. The drive 9 is intended to rotate one of the rollers 3 or 4 in response to the muscular force exerted by the foot of the skater. Each of the skates also comprises an auxiliary drive mechanism 11 which includes a spring-loaded flexible link or cable 12 connected by one end thereof to one of the rollers 3 or 4; in the present embodiment the cable 12 is connected to the front roller 3. Secured to the base 1 to pivot relative to an axis which is parallel with the axes of rotation of the rollers 3 and 4 is a support lever 13 having a slidable member 14 adapted to reciprocate therein, another end of the flexible link 12 of the auxiliary drive 11 being connected to this slidable member 14. The drive 11 is intended to rotate one of the rollers 3 or 4 in response to the muscular force applied thereto by the hand of the skater.

The base 1 have at both ends thereof slots 15 (FIG. 2) accommodating the rollers 3 and 4. The foot support 6 is also provided with a slot 16 at one end thereof exceeding in width the width of the base 1, this end of the foot support being adapted to enclose the base 1.

Figure 3:
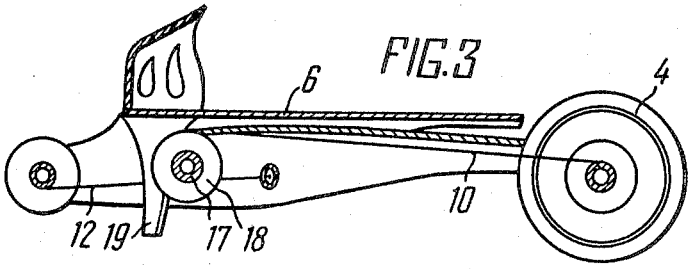
FIG. 3 is a section taken along the line III—III of FIG. 2.
Figure 4:
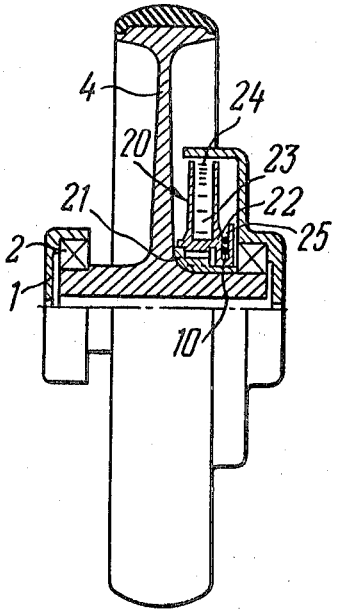
FIG. 4 is a cross-sectioned view of the rollers.

Referring now to FIG. 3, the drive mechanism 9 comprises a shaft 17 rotatably secured in the base 1 to parallel the axis of rotation of the rollers 3 and 4. The shaft 17 is provided with a drum or pulley 18 with one end of the flexible cable 10 fixed and wound thereonto. The drive 9 also comprises a projection or rack 19 made integral with the foot support 6. Another end of the cable 10 is connected to an overrunning clutch 20 (FIG. 4) arranged on the rear roller 4. The cable 12 of the drive 11 is connected to an overrunning clutch 20 of the front roller 3.

The overrunning clutch 20 is comprised of a bushing 21 fixedly secured on a hub of the roller 4, the bushing 21 having recesses with pawls (not shown) pivotally fixed and buried therein for a one-way engagement with gears arranged on the inner side of a ratchet 22. The outer side of the ratchet 22 is provided with an annular groove 23 receiving a flat spring 24, one end of which is attached to the ratchet 22, the other to the base 1 of the skate. The ratchet 22 is further provided with an annular groove 25 accommodating several turns of the cable 10 with one end thereof affixed to the ratchet 22.

Figure 5:
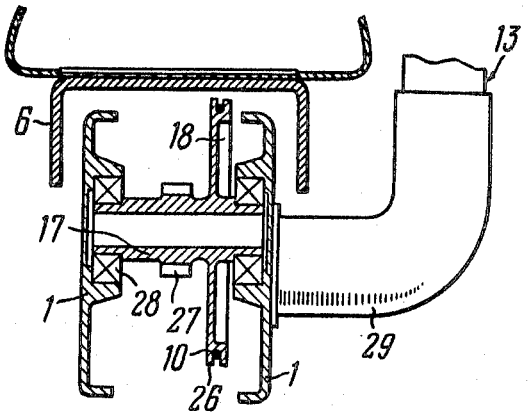
FIG. 5 is a section taken along the line V—V of FIG. 1.
Figure 6:
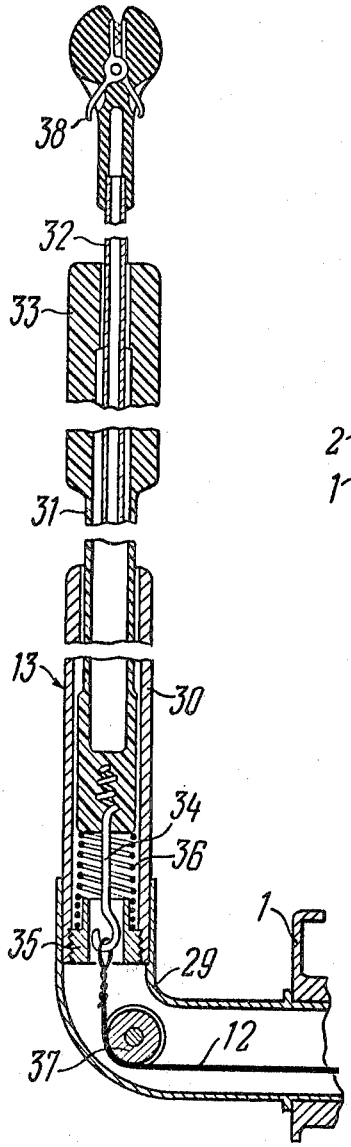
FIG. 6 is a sectional elevation of a support lever of the roller skate according to the invention.

Another end of the cable 10 is fixedly secured in an annular groove 26 (FIG. 5) of the pulley 18. The shaft 17 accommodates a pinion 27, the teeth of which are adapted to mesh with the teeth of the rack 19 (FIG. 3). The pinion 27 (FIG. 5) and the pulley 18 are preferably made integral with the shaft 17, the latter being journaled in the base 1 by means of bearings 28. The lever 13 of the drive 11 is connected to the base 1 through a tube element 29 secured to the base 1 to pivot around an axis which is parallel with the axis of rotation of the rollers 3 and 4. In the herein proposed embodiment the lever 13 is telescopic, viz. made up of three links 30 (FIG. 6), 31 and 32, the middle link of which is actually the slidable member 14, an upper end 33 thereof being adapted to be hand-gripped, for which purpose it is bulbed and knurled. Attached to the lower end of this link 31 is a hook 34 with the flexible cable 12 connected thereto. The lower end of the link 30 carries a hollow or bored screw 35, whereas interposed between the end face of the link 31 and the screw 35 is a spring 36. Secured inside the tube element 29 is a roller 37 to guide the flexible cable 12. The upper end of the support lever 13 has an arrangement for it to be fixed to the clothes of the skater, the arrangement being generally in the form of a clamp 38. The clamp 38 (FIG. 7) serves for fixing the upper end of the lever 13 to the trunk of the skater.

The roller skates according to the invention operate in the following manner.

The skater shifts his weight alternately from one skate to the other, the unloaded skate free-wheeling along a surface. Under the action of the body weight of the skater applied to the foot support 6 (FIGS. 1 and 3), the latter executes a work stroke pivoting around the axle 5. A torque is thus transmitted from the foot support 6 via the teeth of the rack 19 in meshing engagement with the pinion 27 (FIG. 5) to the shaft 17, and from the shaft 17 through the pulley 18 and the flexible cable 10 to the spring-returned ratchet 22 (FIG. 4) and the rear roller 4. During the upward or idle stroke of the foot-support 6, or when the weight of the skater is shifted to the other skate, the action of the spring-loaded flexible cable 10 causes the foot support 6 to return to the initial position by virtue of the forces of rotaty inertia.

Figure 2:
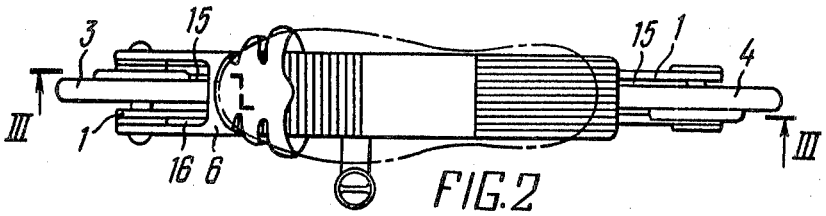
FIG. 2 is a plan view of the skate according to the invention.

When the drive 11 (FIG. 1) is used to increase the rate of propulsion, use is made of the muscular force of the hands of the skater. The upward movement of the bulb or handle 33 (FIG. 3) acts to tension the flexible cable 12 to provide an additional torque to the front roller 3 (FIGS. 1 and 2). When the handle 33 (FIG. 6) is released, the link 31 descends into the initial position, the spring 36 softening the impact. Therewith, the cable 12 is wound onto the ratchet of the overrunning clutch (not shown), while the front roller 3 continues to free-wheel by inertia.

Figure 7:
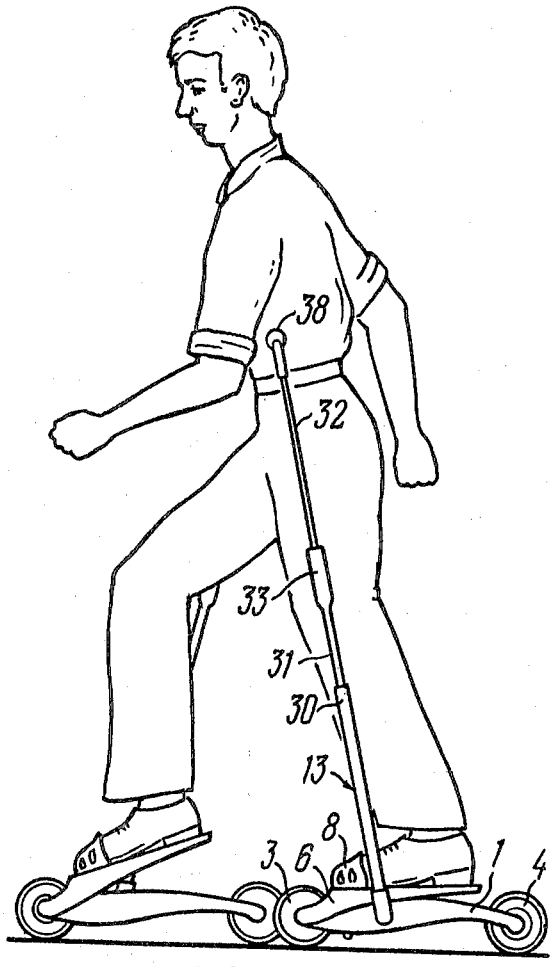
FIG. 7 illustrates the skater moving on the roller skates according to the invention.

Braking of the roller skates is effected by dragging one of the feet on the supporting surface, the foot being easily removable from the foot support 6 (FIG. 7). When necessary, the skater may instantly leave the skates and detach the clamp 38 from his clothes.

What is claimed is:

1. Roller skates, each of the skates comprising:
a base;
front and rear rollers arranged in said base;
a foot support secured to said base to pivot around an axis which is parallel to the axis of rotation of said rollers;
a first drive means for rotating one of said rollers by the muscular force of a foot;
an overrunning clutch of said first drive means arranged on said corresponding roller;
a spring-loaded flexible cable of said first drive means linked by one end thereof with said roller through said overrunning clutch and by another end thereof with said foot support;
a second drive means for rotating said other roller by the muscular force of a hand;
an overrunning clutch of said second drive means arranged on said corresponding roller;
a support lever of said second drive means secured to said base to pivot around an axis parallel with the axes of rotation of said rollers;
a slidable member of said second drive nested in said lever for reciprocating therein; and
a spring-loaded flexible cable of said second drive means linked by one end thereof with said corresponding roller through said overrunning clutch and by another end thereof with said slidable member.

2. Roller skates as claimed in claim 1 comprising:
said support lever adapted to telescope and made up of three links, the middle link being in fact said slidable member; and
a hand-grip or handle arranged on the upper end of said middle link.

3. Roller skates as claimed in claim 1 comprising:
means for fixing said support lever to the clothes of the skater at the level of his trunk arranged on the upper end of said support lever.

4. Roller skates as claimed in claim 2 comprising:
means for fixing said support lever to the clothes of the skater at the level of his trunk arranged on the upper end of said support lever.

* * * * *